US006149791A

United States Patent [19]

Roesener et al.

[11] Patent Number: 6,149,791

[45] Date of Patent: Nov. 21, 2000

[54] PROCESS AND APPARATUS FOR THE SELECTIVE ELECTROPLATING OF ELECTRICAL CONTACT ELEMENTS

[75] Inventors: Klaus Guenter Roesener; Kai Erik Liebich, both of Berlin; Hans-Joachim Neese, Eisengen; Uwe Liebig, Berlin; Johannes Guendel, Zug, all of Germany

[73] Assignee: Schempp & Decker Praezisionsteile und Oberflaechentechnik GmbH, Berlin, Germany

[21] Appl. No.: 09/020,247

[22] Filed: Feb. 6, 1998

[30] Foreign Application Priority Data

Feb. 6, 1997 [DE] Germany ..... 197 04 369

[51] Int. Cl.[7] ..... C25D 5/02

[52] U.S. Cl. ..... 205/122; 204/206; 204/224 R; 204/237; 204/275; 205/128; 205/129; 205/133; 205/136

[58] Field of Search ..... 205/118, 122, 205/125, 128, 129, 133, 136; 204/224 R, 206, 237, 275

[56] References Cited

U.S. PATENT DOCUMENTS

| | | | |
|---|---|---|---|
| 4,405,410 | 9/1983 | Sebastien | 205/122 |
| 4,427,520 | 1/1984 | Bahnsen | 204/224 R |
| 4,554,062 | 11/1985 | Sergio | 204/206 |
| 4,595,464 | 6/1986 | Bacon et al. | 205/117 |
| 4,597,845 | 7/1986 | Bacon et al. | 204/206 |
| 4,655,881 | 4/1987 | Tezuka et al. | 205/104 |
| 4,683,045 | 7/1987 | Murata et al. | 204/206 |

FOREIGN PATENT DOCUMENTS

| | | |
|---|---|---|
| 0 222 232 | 5/1987 | European Pat. Off. . |
| 25 04 780 | 8/1976 | Germany . |
| 33 17 970 C2 | 11/1984 | Germany . |

OTHER PUBLICATIONS

2nd East Congress, Nov. 1991, publisher: Eugen G. Leuze, Saulgau, 1992 month of publication not available, pp. 30 to 37.

*Primary Examiner*—Kathryn Gorgos
*Assistant Examiner*—William T. Leader
*Attorney, Agent, or Firm*—Venable; George H. Spencer; Ashley J. Wells

[57] ABSTRACT

A process and apparatus for the selective electroplating of electrical contact elements, used for coating at least one contact surface of a metal base for the contact elements with an electrolyte, containing a material with a higher conductivity as compared to the base. The electrolyte is applied with a long stretched-out plastic electroplating tip which has a plurality of channel passages through which the electrolyte passes and which are arranged at a right angle to the tip. The plurality of channel passages terminates at and empties into at least one discharge opening which extends along the entire length of the tip. The electroplating tip, when it is in the operating position, is arranged such that the at least one discharge opening is positioned on the bottom and extends horizontally. The electrolyte is supplied to the electroplating tip from above. The base is moved at the lower end of the electroplating tip and parallel to said tip, in such a way that the region thereof, which is intended as contact surface, is located at a uniform distance from and at the level of the discharge opening.

8 Claims, 4 Drawing Sheets

PROCESS AND APPARATUS FOR THE SELECTIVE ELECTROPLATING OF ELECTRICAL CONTACT ELEMENTS

CROSS-REFERENCE TO RELATED APPLICATION

This application claims the priority of Patent Application DE 197 03 369.0, filed in Germany on Feb. 6, 1997, the subject matter of which is incorporated herein by reference.

BACKGROUND OF THE INVENTION

The present invention relates to a process and apparatus for the selective electroplating of electrical contact elements, which process is used for coating at least one contact surface of a metal base for the contact elements with an electrolyte containing a material with higher conductivity as compared to the base (see the report of the $2^{nd}$ EAST Congress, November 1991, publisher: Eugen G. Leuze, Saulgau, 1992, pages 30 to 37).

Such a process is used, for example, for the coating of contact protuberances of electrical contact elements. The process is used mainly for the gold-plating of contact protuberances for spring contacts composed of copper-containing materials. Basically, it can also be used for bases composed of other materials, e.g. bronze, nickel silver, copper-beryllium or stainless steel. In each case, one contact surface of a base composed of an electrically less, highly conductive metal is coated with an electrically highly conductive metal. Metals suitable for this are preferably gold and palladium, but also platinum, ruthenium, rhodium, silver, nickel or copper can also be used. Basically, it is generally sufficient in this case if only the direct contact region of a contact element is coated with the highly conductive material. Since for economic reasons the given problems are most serious for "gold", what is hereinafter explained is the electroplating with gold of contact springs made of bronze, and is representative for all other possible materials.

Based on the known process according to the above-mentioned magazine "EAST" Report, contact springs that are punched out of an endless band and connected therein are electroplated while passing through. During this process, the section of the contact springs to be coated is brought into contact with a cylinder, which rotates around its axis and is wetted on the surface with electrolyte. With this process, it is unavoidable that the ends of the contact springs are coated completely. In addition, the use of coating material is relatively high. The process is therefore not economical, in particular if gold is used as coating material.

It is, therefore, the object of the invention to provide a process and apparatus of the above type in which less gold is used.

SUMMARY OF THE INVENTION

In accordance with the present invention, an elongated electroplating tip made of plastic is used to apply the electrolyte, the tip being provided with at least one discharge opening extending along its entire length and a plurality of channel-type passages through which the electrolyte can pass and which feed into said electroplating tip. The electroplating tip in the operating position is arranged such that the horizontally extending discharge opening is at the bottom, while the passages extend upward, starting with the discharge opening. The electrolyte for the electroplating tip is supplied from the top, and the base at the lower end of the electroplating tip is moved parallel to it, in such a way that the base region intended as contact surface is located at a uniform distance, at the level of the discharge opening.

With this process, the gold-containing electrolyte impacts only with the contact surface to be coated of the contact springs. As a result of the feeding of the electrolyte from above, this occurs automatically and with sufficient pressure. The layer thickness that is needed to obtain a usable contact surface is achieved as a result of the long stretched-out electroplating tip, through which the contact springs are coated with electrolyte during their complete path along said tip. In addition, supplying the electrolyte from above results in a simple design for the complete arrangement and a simple mode of operation. It is of particular importance here that no covering elements or structural components are needed. The electrolyte that flows off toward the bottom hardly comes in contact with the outside surface of the contact springs. Furthermore, the inside space of the contact springs is left virtually uncoated with gold. The coating is therefore confined essentially to the place of contact to be coated. In this way, the use of gold is reduced virtually to the minimum required amount.

Other advantageous features of the present invention are described below.

BRIEF DESCRIPTION OF THE DRAWINGS

The above and other features and advantages of the invention will be further understood from the following detailed description of the preferred embodiments with reference to the accompanying drawings in which.

DETAILED DESCRIPTION OF THE PREFERRED EMBODIMENTS

The invention as described below relates to a contact spring made of bronze that is to be coated with gold, the invention, however, not being limited to these materials.

Figure 1:
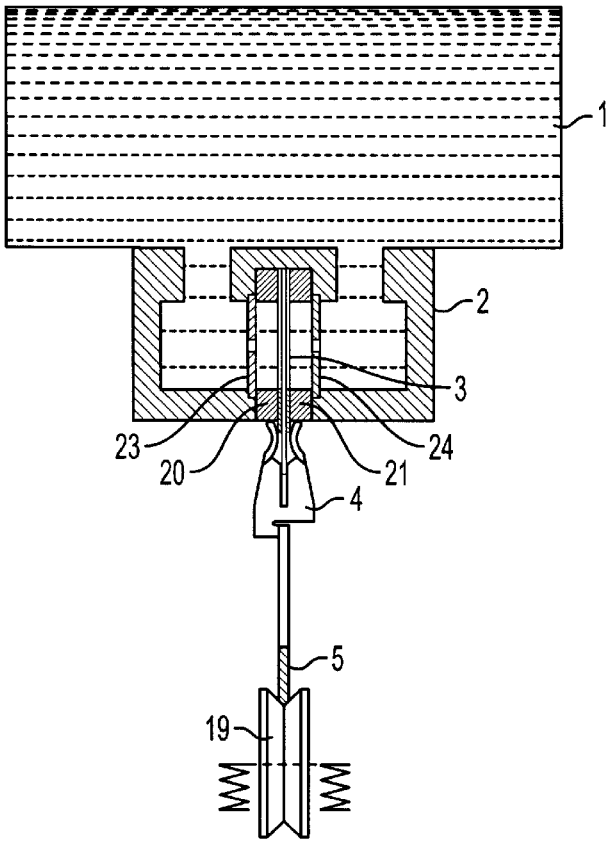
FIG. 1 is a diagrammatic view of an arrangement for carrying out the process according to the invention.
Figure 2:
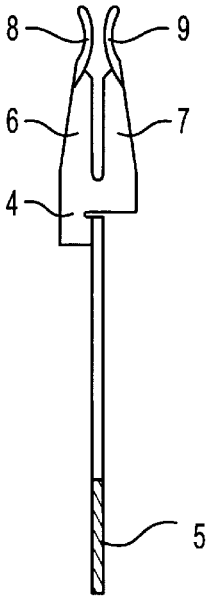
FIG. 2 is a contact spring that can be coated with this process.
Figure 3:
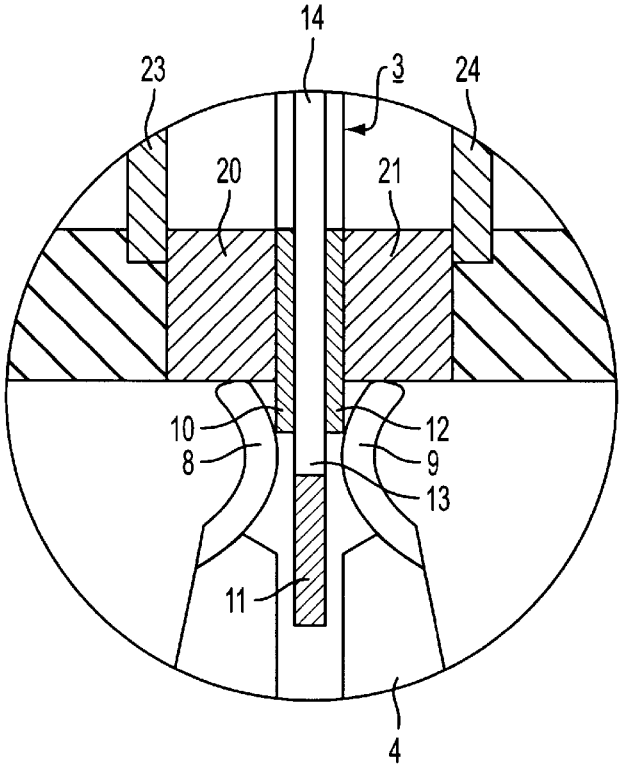
FIG. 3 is an enlarged detail of FIG. 1.
Figure 4:
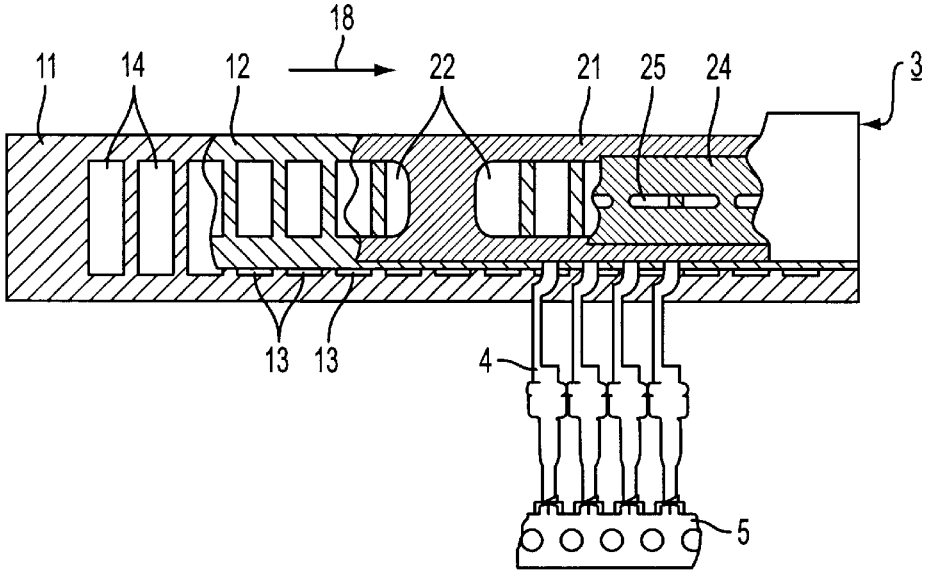
FIG. 4 is another enlarged view from the side of FIG. 1, with partially removed layers.
Figure 5:
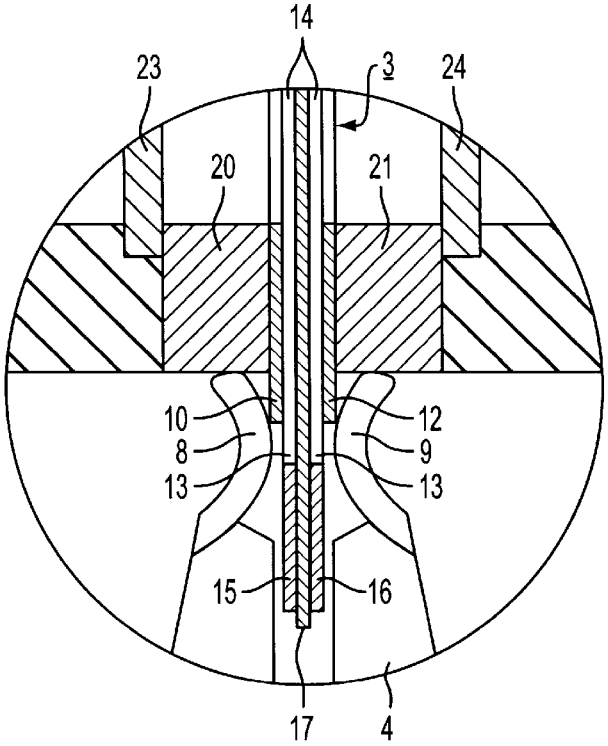
FIG. 5 is a modified embodiment of the detail shown in FIG. 3.

Referring to FIGS. 1 and 2, a gold electrolyte is located inside a chamber 1 for distributing electrolyte. Below this and arranged inside a chamber-like holder 2 that is connected via passages to the electrolyte chamber 1 is an electroplating tip 3, the configuration of which is shown in FIGS. 3, 4 and 5. The electroplating tip is used for a targeted feeding of the electrolyte to a contact spring 4 which is to be coated with gold contact surfaces. In a continuous design, the contact spring 4, together with a plurality of identical contact springs, is mounted to a support strip 5. As shown in FIG. 1, the electrolyte chamber 1 is located above the electroplating tip 3 and the contact spring 4 is arranged at the lower end of the tip. Thus, the electrolyte is supplied from above by the electroplating tip 3 to the contact spring 4.

The contact spring 4 to be coated in the illustrated embodiment has two arms, that it so say, the two spring halves or arms 6 and 7. The curved arms 6 and 7 have contact protuberances 8 and 9 that are to be coated with gold. The remaining surface of the contact spring 4 are not to be coated.

The electroplating tip 3 is made from plastic foils, e.g. mylar. However, other chemically stable plastic materials can be used as well. In accordance with FIG. 3, the electroplating tip 3 has three adjoining foils 10, 11, 12, the center foil 11 being longer than the two side foils 10 and 12. The projecting region contains discharge openings 13 for the electrolyte which exist over the total length or width of the electroplating tip 3. In the operating position, the discharge openings 13 are on the bottom. As shown in FIG. 4, the three foils 10, 11 and 12 enclose channel-type passages 14 with discharge openings 13 at their lower end. They function to supply the electrolyte to the discharge openings 13.

An electroplating tip 3 composed of three foils 10, 11 and 12 is produced, for example, in such a way that sections are initially punched out of the foil 11. The resulting blanks form the later passages 14. Continuous strips remain in this case on both longitudinal edges of the foil 11, so that the foil 11 looks like a type of double comb. Following that, the two foils 10 and 12, which have perforations that are identical to those in foil 11, are laminated onto different sides of the perforated foil 11. Their punched-out passages are arranged such that they cover the passages 14 in foil 11. However, in accordance with FIG. 4, they cover the passages 14 in the lower region of foil 11 in part such that the discharge openings 13 remain free. As shown in FIGS. 3 and 4, the foil 11 projects over the foils 10 and 12. When the electroplating tip 3 is in use, the contact protuberances 8 and 9 are wetted equally by the electrolyte. Thus, a layer with approximately the same thickness is precipitated on both contact protuberances 8 and 9.

The length of the electroplating tip 3 depends on the thickness of the layers to be precipitated. It can, for example, be a few centimeters long, but it can also be approximately 1.5 m long. An average value for the length of the electroplating tip 3 is about 800 mm. The contact springs 4 to be coated must be moved as quickly as possible, depending on the layer thickness of the coating to be produced. They are moved along the electroplating tip 3 at a speed of more than 3 m/min, generally at 12 m/min. However, higher discharge speeds are possible as well if two or more or a higher number of electroplating tips 3 are used.

The electroplating tip 3 for another embodiment, shown in FIG. 5, has five foils 10 and 12 as well as 15, 16 and 17. In this embodiment, blanks are punched out of foils 15 and 16 to form the passages 14. The punched foils 15 and 16 are laminated onto the inside-positioned foil 17, while the outer foils 10 and 12 that are also perforated are in turn laminated onto the foils 15 and 16. With this type of embodiment for the electroplating tip 3, passages 14 and discharge openings 13 exist on both sides of the foil 17. The electrolyte is thus supplied separately to the contact protuberances 8 and 9. With an electroplating tip 3 of this type, layers of different thicknesses can be precipitated on the two contact protuberances 8 and 9 by using separate electrolyte chambers and currents of different amperage.

Figure 7:
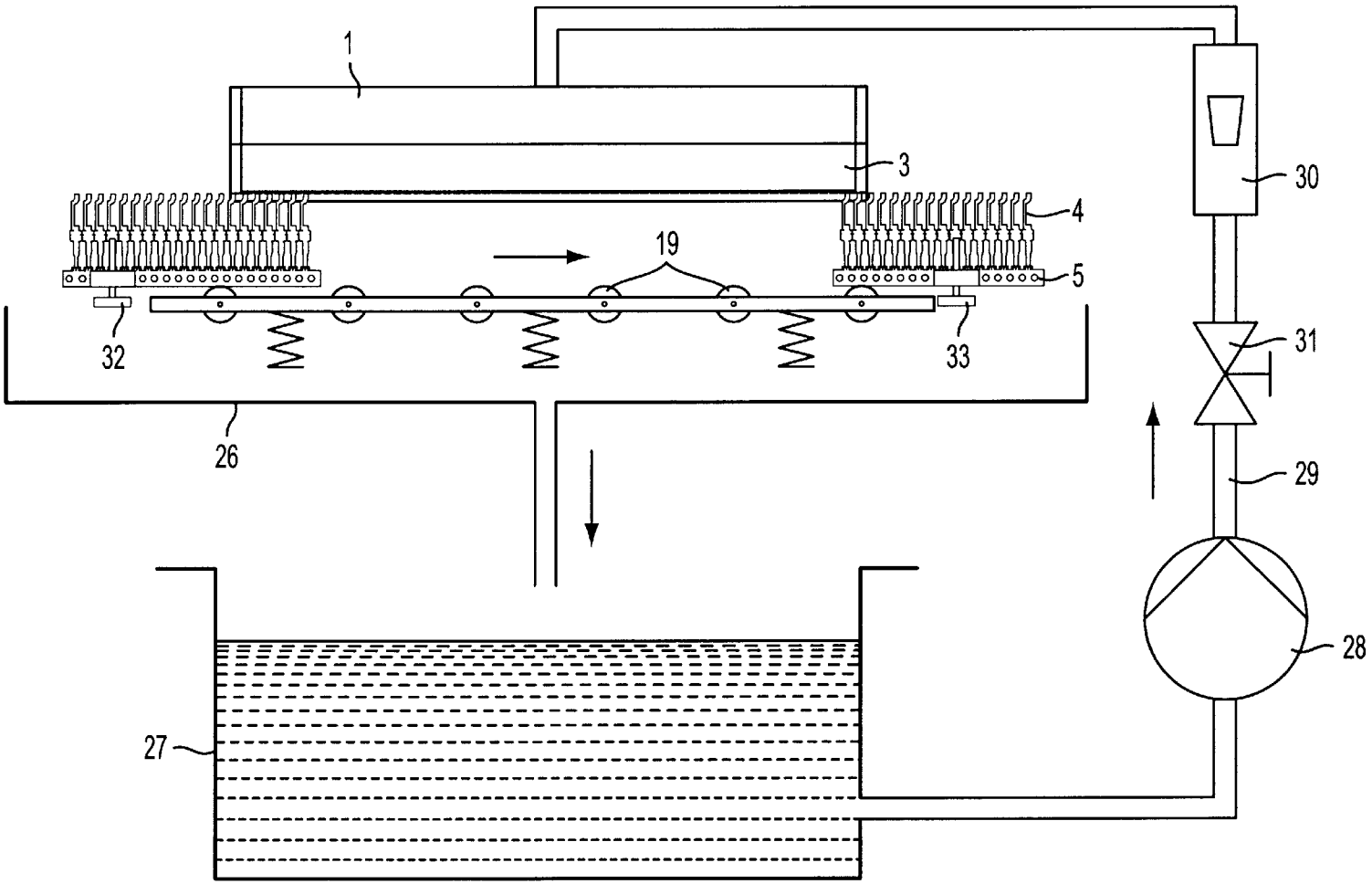
FIG. 7 is a view from the side of the arrangement according to FIG. 6.

During the electroplating process, the contact springs 4 are arranged such that their contact protuberances 8 and 9 are positioned at the level of the discharge openings 13. Thus, when the springs are moved along the electroplating tip 3 in the direction of arrow 18, drawn into the configuration depicted in FIG. 4, they are constantly wetted with electrolyte. To achieve this, the contact springs 4 are preferably moved along by force. With their carrier strip 5, the springs slide along elastically positioned rollers 19 which are made of plastic and are shown in FIG. 7, and are pressed against rails 20 and 21 that are also composed of plastic. These fit on the side against the electroplating tip 3 and, according to FIG. 4, are provided with elongated holes 22 through which the electrolyte can pass.

Figure 6:
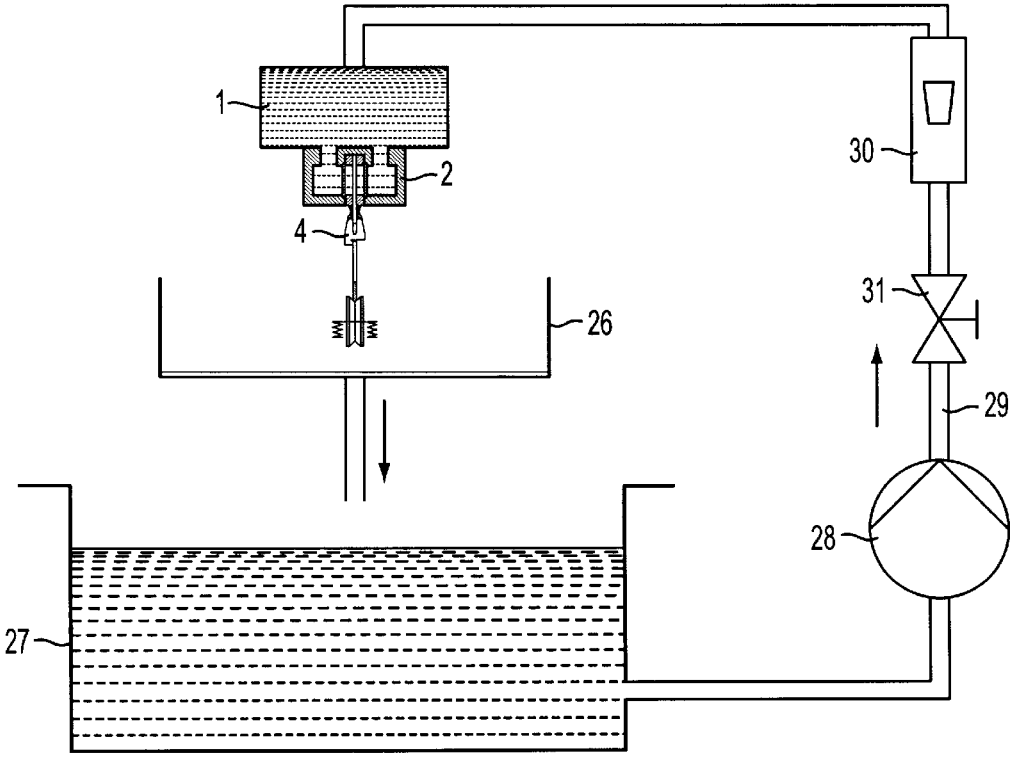
FIG. 6 is an arrangement according to FIG. 1, completed and reduced in size.

According to FIG. 6, the electrolyte chamber 1 is arranged above the contact springs 4 to be coated and essentially also above the electroplating tip 3. In accordance with the illustration in FIGS. 1 and 6, the electroplating tip 3 projects into the electrolyte chamber 1, that is to say, into the holder 2 connected to the chamber. During the course of the process of coating the contact protuberances 8 and 9, the electroplating current flows between the two anodes 23 and 24 and the cathode-connected contact springs 4. The anodes 23 and 24 are provided approximately in their center region with elongated holes 25 (see FIG. 4) for the electrolyte to pass through. During the operation, the contact springs 4 are pushed by the rollers 19 against the rails 20 and 21.

An electroplating tip 3 composed of the three foils 10, 11 and 12 is used for the arrangement shown in FIG. 6. The electrolyte is then fed in the same way and with the same current strength to the contact protuberances 8 and 9 to be coated. If an electroplating tip 3 according to FIG. 5 is used, the electrolyte chamber 1 can be divided into two separate chambers. In that case, different power sources can be used for the two chambers so that the two contact protuberances 8 and 9 are coated with currents of different amperages. This results in layers of different thickness on the two contact protuberances 8 and 9, which can be used to further lower the use of gold.

The electrolyte flows through the contact springs 4 into a catch basin 26, shown in FIG. 6, irrespective of the configuration of the electroplating tip 3 (three or five foils). As a result of this, a thin gold layer is also created on the regions of arms 6 and 7, which are outside of the contact protuberances 8 and 9, that is to say, also on the inside of contacts springs 4. However, these layers are very thin owing to the process used, which is the targeted feeding of the electrolyte. They can be removed in a simple stripping operation. The gold can subsequently be recovered in a conventional manner. This thin coating of the contact springs 4 at locations where it is not desirable per se, which cannot be avoided totally, can also be used, for example, to coat only the contact protuberance 8 directly via the discharge opening 13. In that case, no discharge openings exist in a respective electroplating tip 3 on the side of the contact protuberances 9, or no electrolyte is fed to this side. The contact protuberances 9 nevertheless also have a thin layer of gold at the completion of the process.

In accordance with FIG. 7, the electrolyte flows from the catch basin 26 to a storage tank 27. During the course of the process, the electrolyte is pumped into the electrolyte chamber 1 by means of a pump 28. A flow meter 30 can be arranged in the respective pipe 29, by means of which the flow meter amount of electrolyte fed to the electrolyte chamber 1 can be regulated with way of a valve 31.

FIG. 7 is a diagrammatic side view of the arrangement for carrying out the process. In addition to the details already shown in the other figures, the contacting rollers 32 and 33 are drawn in, which connect the contact springs 4 to the cathode of a rectifier (not shown).

It will be understood that the above description of the present invention is susceptible to various modifications, changes and adaptations, and the same are intended to be comprehended within the meaning and range of equivalents of the appended claims.

What is claimed is:

1. A process for the selective electroplating of electrical contact elements, which process is used for coating at least one contact surface of a metal base for the contact elements with an electrolyte containing a material with higher conductivity as compared to the base, comprising the steps of:

(a) applying the electrolyte with an elongated electroplating tip made of plastic, which tip has a plurality of channel passages for the electrolyte to pass through defined therein, wherein the plurality of channel passages terminates at and empties into at least one discharge opening which extends along the entire length of the tip;

(b) arranging the electroplating tip, in the operating position, such that the at least one discharge opening is positioned horizontally on the bottom whereas the passages extend from the at least one discharge opening upward;

(c) supplying the electrolyte to the electroplating tip from above; and (d) moving the base at the lower end of the electroplating tip parallel to said tip such that the region intended for the contact surface of said base is positioned at a uniform distance from and at the level of the at least one discharge opening.

2. The process according to claim 1, wherein, for the production of two oppositely-arranged contact protuberances on the two arms of a two-arm contact spring, the electroplating tip is arranged in the space between the two arms.

3. The process according to claim 2, wherein at least two electrolyte chambers are provided, and wherein different ones of the at least two electrolyte chambers and varied current strengths are used for production of the two oppositely-arranged contact protuberances.

4. The process according to claim 1, wherein the base is forcibly guided by the electroplating tip.

5. Apparatus for the selective electroplating of electrical contact elements to coat at least one contact surface of a metal base for the contact elements with an electrolyte containing a material with higher conductivity as compared to the base, the apparatus comprising:

(a) an elongated electroplating tip made of plastic for applying the electrolyte, said tip having a plurality of channel passages for the electrolyte to pass through defined therein, wherein the plurality of channel passages terminates at and empties into at least one discharge opening which extends along the entire length of the tip;

(b) said electroplating tip, in the operating position, being arranged such that the at least one discharge opening is positioned horizontally on the bottom whereas the passages extend from the at least one discharge opening upward;

(c) means for supplying the electrolyte to the electroplating tip from above; and (d) means for moving the base at the lower end of the electroplating tip parallel to said tip such that the region intended for the contact surface of said base is positioned at a uniform distance from and at the level of the at least one discharge opening.

6. The apparatus according to claim 5, wherein said electroplating tip is composed of at least 3 adjoining plastic foils that enclose the passages for the electrolyte.

7. The apparatus according to claim 6, further comprising an electrolyte chamber containing the electrolyte and arranged above said electroplating tip.

8. The apparatus according to claim 7, wherein the passages of said electroplating tip that extend upward in the operating position projects into said electrolyte chamber.

* * * * *

UNITED STATES PATENT AND TRADEMARK OFFICE

CERTIFICATE OF CORRECTION

PATENT NO. : 6,149,791
DATED : November 21, 2000
INVENTOR(S) : Klaus-Gunter ROESENER et al.

It is certified that error appears in the above-identified patent and that said Letters Patent is hereby corrected as shown below:

On the title page, item [75], change "Liebich " to -- Liebisch --.

Signed and Sealed this

First Day of May, 2001

*Attest:*

Nicholas P. Godici

NICHOLAS P. GODICI

*Attesting Officer*

*Acting Director of the United States Patent and Trademark Office*